US005704007A

United States Patent [19]

Cecys

[11] Patent Number: 5,704,007

[45] Date of Patent: Dec. 30, 1997

[54] UTILIZATION OF MULTIPLE VOICE SOURCES IN A SPEECH SYNTHESIZER

[75] Inventor: Mark L. Cecys, San Jose, Calif.

[73] Assignee: Apple Computer, Inc., Cupertino, Calif.

[21] Appl. No.: 727,845

[22] Filed: Oct. 4, 1996

Related U.S. Application Data

[63] Continuation of Ser. No. 212,488, Mar. 11, 1994, abandoned.

[51] Int. Cl.[6] ..... G10L 5/02; G10L 9/00

[52] U.S. Cl. ..... 395/2.69; 395/2.67; 395/2.7

[58] Field of Search ..... 395/2.1, 2.38, 395/2.67, 2.69–2.78

[56] References Cited

U.S. PATENT DOCUMENTS

| | | | |
|---|---|---|---|
| 4,731,847 | 3/1988 | Lybrook et al. | 395/2.69 |
| 4,754,485 | 6/1988 | Klatt | 395/2.69 |
| 4,833,718 | 5/1989 | Sprague | 395/2.38 |
| 4,896,359 | 1/1990 | Yamamoto et al. | 395/2.69 |
| 4,979,216 | 12/1990 | Malsheen et al. | 395/2.69 |
| 5,111,409 | 5/1992 | Gasper et al. | 395/152 |
| 5,278,943 | 1/1994 | Gasper et al. | 395/2 |
| 5,400,434 | 3/1995 | Pearson | 395/2.73 |

OTHER PUBLICATIONS

O'Shaughnessy, "Recent progress in automatic text–to–speech synthesis", Proceedings of the 36th Midwes Symposium on Circuits and Systems, p. 1527–30 vol. 2, 16–18 Aug. 1993.

de Veth et al, "Extraction of control parameters for the voice source in a text–to–speech system"; ICASSP 90, p. 301–4 vol. 1, 3–6 Apr. 1990.

Sugamura et al, "Speech processing technologies and telecommunications applications a NTT"; Proceedings. Second IEEE Workshop on interactive voice technology for telecommunications applications, pp. 37–42, 26–27 Sep. 1994.

Kang et al, "Canned speech for tactical voice message systems"; Proceedings of the tactical communications conference, p. 47–56 vol. 1, 28–30 Apr. 1992.

Nakajima et al, "Automatic generation of synthesis units based on context oriented clustering"; ICASSP 88, pp. 659–662 vol. 1, 11–14 Apr. 1988.

Carlson et al, "Voice source rules for text–to–speech synthesis"; ICASSP–89, pp. 223–226 vol. 1, 23–26 May 1989.

*Primary Examiner*—Tariq R. Hafiz
*Attorney, Agent, or Firm*—Carr, DeFilippo & Ferrell

[57] ABSTRACT

Utilization of one or more voice sources in a speech synthesizer to provide improved synthetic speech. Having a speech synthesizer with the capability to select among and between a multiplicity of voice sources provides a higher quality and greater variety of possible synthetic speech sounds. This is particularly true when the multiplicity of voice sources are predetermined to have particular speech qualities and spectral content such as may be desired to convey emotional vocal content in synthetic speech.

21 Claims, 9 Drawing Sheets

UTILIZATION OF MULTIPLE VOICE SOURCES IN A SPEECH SYNTHESIZER

This is a continuation of application Ser. No. 08/212,488, filed on Mar. 11, 1994, now abandoned.

CROSS-REFERENCE TO RELATED APPLICATIONS

This application is related to co-pending patent application having Ser. No. 08/212,602, entitled "UTILIZATION OF A RECORDED SOUND SAMPLE AS A VOICE SOURCE IN A SPEECH SYNTHESIZER" having the same inventive entity, assigned to the assignee of the present application, and filed with the United States Patent and Trademark Office on the same day as the present application.

FIELD OF THE INVENTION

The present invention relates generally to the synthesis of human speech. More specifically, the present invention relates to electronic text to speech synthesis wherein the speech synthesizer used has available to it one or more voice sources.

BACKGROUND OF THE INVENTION

Re-creation or synthesis of human speech has been an objective for many years and has been discussed in serious texts as well as in science fiction writings. Human speech, like many other natural human abilities such as sight or hearing, is a fairly complicated function. Synthesizing human speech is therefore far from a simple matter.

Various approaches have been taken to synthesize human speech. One approach to human speech synthesis is known as concatenative. Concatenative synthesis of human speech is based on recording wave form data samples of real human speech of predetermined text. Concatenative speech synthesis then breaks down the pre-recorded original human speech into segments and generates speech utterances by linking these human speech segments to build syllables, words, or phrases. The size of the pre-recorded human speech segments may vary from diphones, to demi-syllables, to whole words.

Various approaches to segmenting the recorded original human voice have been used in concatenative speech synthesis. One approach is to break the real human voice down into basic units of contrastive sound. These basic units of contrastive sound are commonly known in the art of the present invention as phones or phonemes.

Another approach to human speech synthesis is known as parametric. Parametric synthesis of human speech uses mathematical models to recreate a desired speech sound. For each desired sound, a mathematical model or function is used to generate that sound. Thus, other than possibly in the creation or determination of the underlying mathematical models, parametric synthesis of human speech is generally devoid of any original human speech input.

There are two general categories of parametric speech synthesizers. One type of parametric speech synthesizer is known as an articulatory synthesizer which mathematically models the physical aspects of the human lungs, larynx, and vocal and nasal tracts. The other type of parametric speech synthesizer is known as a formant synthesizer which mathematically models the acoustic aspects of the human vocal tract.

Referring now to FIG. 1, a typical prior art Text-To-Speech (TTS) System 100 can be seen. The input to TTS System 100 is a text string which may comprise the standard alphabetical characters spelling out the desired text, a phonetic translation of the desired text, or some other form representative of the desired text. The first module of TTS System 100 is Language Processor 101 which receives the input text string or other text representation. The primary function of Language Processor 101, as is well known in the art, is to specify the correct pronunciation of the incoming text by converting it into a sequence of phonemes. By pre-processing symbols, numbers, abbreviations, etc., the input text is first normalized into standard input. The normalized text is then converted to its phonetic representation by applying lexicon table look-up, morphological analysis, letter-to-sound rules, etc.

The second module of TTS System 100 is Acoustic Processor 103 which receives as input the phoneme sequence from Language Processor 101. The primary function of Acoustic Processor 103, as is well known in the art, is to convert the phoneme sequence into various synthesizer controls which specify the acoustic parameters of the output speech. The phoneme sequence may be further refined and modified by Acoustic Processor 103 to reflect contextual interactions. Controls for parameters such as prosody (e.g., pitch contours and phoneme duration), voicing source (e.g., voiced or noise), transitional segmentation (e.g., formants, amplitude envelopes) and/or voice color (e.g., timbre variations) may be calculated, depending upon the specific synthesizer type Acoustic Processor 103 will control.

The third module of TTS System 100 is Speech Synthesizer 105 which receives as input the control parameters of the desired text from Acoustic Processor 103. Speech Synthesizer 105, as is well known in the art, converts the control parameters of the desired text into output wave forms representative of the desired spoken text. Loudspeaker 107 receives as input the output wave forms from Speech Synthesizer 105 and outputs the resulting synthesized speech of the desired text.

In the formant type of parametric speech synthesizer, referring now to FIG. 2, a typical configuration of Speech Synthesizer 105 of FIG. 1 can be seen. With a formant type speech synthesizer, Speech Synthesizer 105 is typically comprised of a voice source 201 and a noise source 203. Voice source 201 is used to simulate the glottis excitation of the vocal tract while noise source 203 is used to simulate some of the other features of the human vocal tract such as the tongue, teeth, lips, etc. As is common in the art, the voice or sound source (after first being passed through a low pass filter, as will be explained more fully below) and the noise source are passed, either singly or in combination through sum circuitry or processing 205, through a resonator and filter network.

The resonator and filter network is typically comprised of a complex network of filters and resonators coupled in parallel and/or cascade fashion whose sole purpose is to create the desired formants for the text to be synthesized. For example, resonators 207, 209 and 211 comprise a cascade resonator configuration while resonators 213, 215 and 217 comprise a parallel resonator configuration. Note that the filter and resonator network of FIG. 2 is merely representative of the type of networks commonly utilized for formant type parametric speech synthesizer. Many combinations and variations of filter and resonator networks have been used in the past.

Finally, the output of the resonator and filter network is combined by sum circuitry or processing 218 and is then modified by some output processing 219 to resolve any impedance mismatch which would typically occur between the mouth and the outside air.

Although numerous variations and combinations of resonators, filters, and other forms of signal processing have been applied to the output of the voice and/or noise sources 201 and 203 in the past, the resulting output from the various resonator and filter networks has typically lacked the naturalness and flexibility desired. Again, the recreation or synthesis of human speech is a complex function which is further compounded by the sensitivity of the standard measuring device—the human ear. If the resulting synthesized speech contains any flat, wooden, static or robotic qualities, the human ear often readily perceives this. The listener's reaction to these imperfections in synthesized speech ranges from minor annoyance to lack of comprehension of the synthesized spoken words.

The present invention overcomes some of the limitations in the prior art speech synthesizers by utilizing a multiplicity of voice sources, one or more of which may comprise a recorded sound wave sample, which thus produces a more natural and flexible synthesized speech sound.

Further, in the prior art parametric speech synthesizers, the source of the synthetic speech has been limited to the voice and noise source modulated and processed by the resonator and filter networks as discussed above. And while concatenative speech synthesizers have utilized recorded human speech segments, the objective there was to essentially use real human speech to generate the desired synthetic speech of the same sound. However, utilization of recorded wave samples of real human speech in place of the voice source in parametric synthesizers is new to the art presumably because of the likely disparity between the recorded human speech segments and the desired spectral characteristics of a voice source.

The present invention takes a different approach than in the prior art by also being capable of utilizing one or more recorded sound samples as the voice source in a parametric speech synthesizer. Utilization of such sound sources provides entirely new, essentially limitless spectral qualities to the voice source of a speech synthesizer. Not only can a wider range of synthetic speech be generated due to the wider variety of voice sources, but further, a wide range of interesting and entertaining speech effects can be achieved. For example, a recorded sound wave sample of a teakettle can be used to create a talking teakettle thus providing an entertaining way to communicate with children who otherwise might lack the interest or attention span to listen to the possibly educational information imparted thereby.

SUMMARY AND OBJECTS OF THE INVENTION

It is an object of the present invention to provide an improved synthetic text-to-speech system.

It is a further object of the present invention to provide a speech synthesizer with multiple voice sources.

It is a still further object of the present invention to provide a speech synthesizer with multiple voice sources wherein each of the voice sources comprises certain desirable spectral content.

It is an even further object of the present invention to provide a speech synthesizer with multiple voice sources wherein each of the voice sources comprises certain desirable spectral content such that more natural, human-like synthetic speech can be generated.

It is still an even further object of the present invention to provide a speech synthesizer with multiple voice sources wherein each of the voice sources comprises certain desirable spectral content such that more natural, human-like synthetic speech can be generated with reduced reliance on signal processing.

The foregoing and other advantages are provided by a synthetic text-to-speech generating method comprising generating a set of speech synthesizer control parameters representative of text to be spoken and converting the speech synthesizer control parameters into output wave forms representative of the synthetic speech to be spoken by selecting at least one voice source from a multiplicity of voice sources in a speech synthesizer.

The foregoing and other advantages are also provided by an apparatus for generating synthetic text-to-speech, the apparatus comprising a means for generating a set of speech synthesizer control parameters representative of text to be spoken and a means for converting the speech synthesizer control parameters into output wave forms representative of the synthetic speech to be spoken by a means for selecting at least one voice source from a multiplicity of voice sources in a speech synthesizer.

Other objects, features and advantages of the present invention will be apparent from the accompanying drawings and from the detailed description which follows.

BRIEF DESCRIPTION OF THE DRAWINGS

The present invention is illustrated by way of example and not limitation in the figures of the accompanying drawings, in which like references indicate similar elements, and in which.

DETAILED DESCRIPTION OF THE INVENTION

Figure 3:
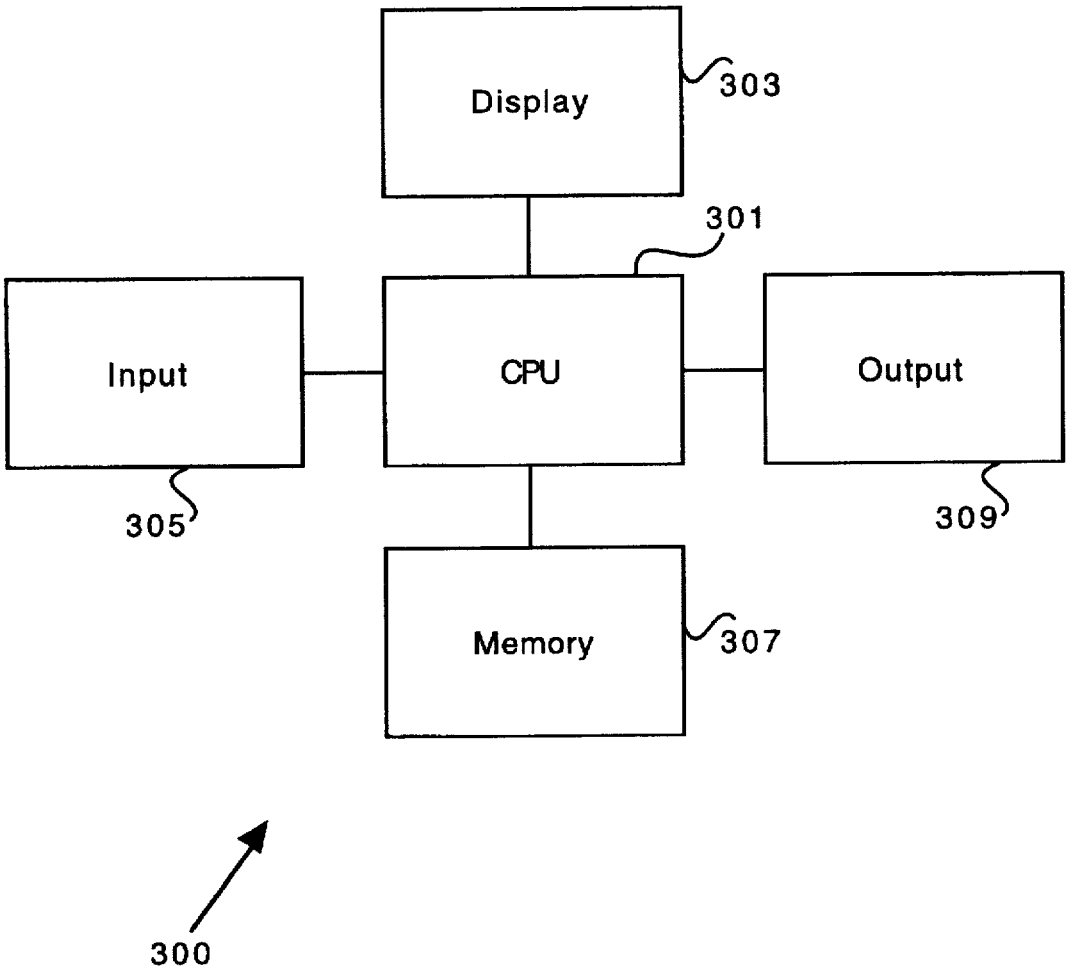
FIG. 3 is a simplified block diagram of a computer system for the present invention.

The present invention will be described below by way of a preferred embodiment as an improvement over the aforementioned speech synthesis systems, and implemented on an Apple Macintosh® (trademark of Apple Computer, Inc.) computer system. It is to be noted, however, that this invention can be implemented on other types of computers and electronic systems. Regardless of the manner in which the present invention is implemented, the basic operation of a computer system 300 embodying the present invention, including the software and electronics which allow it to be performed, can be described with reference to the block diagram of FIG. 3, wherein numeral 301 indicates a central processing unit (CPU) which controls the overall operation of the computer system, numeral 303 indicates an optional standard display device such as a cathode ray tube (CRT) or liquid crystal display (LCD) screen, numeral 305 indicates an optional input device which may include both a standard keyboard and a pointer-controlling device such as a mouse as well as a microphone or other sound input device, numeral 307 indicates a memory device which stores programs according to which the CPU 301 carries out various predefined tasks, and numeral 309 indicates an optional output device which may include a loudspeaker for playing the improved speech generated by the present invention.

Figure 1:
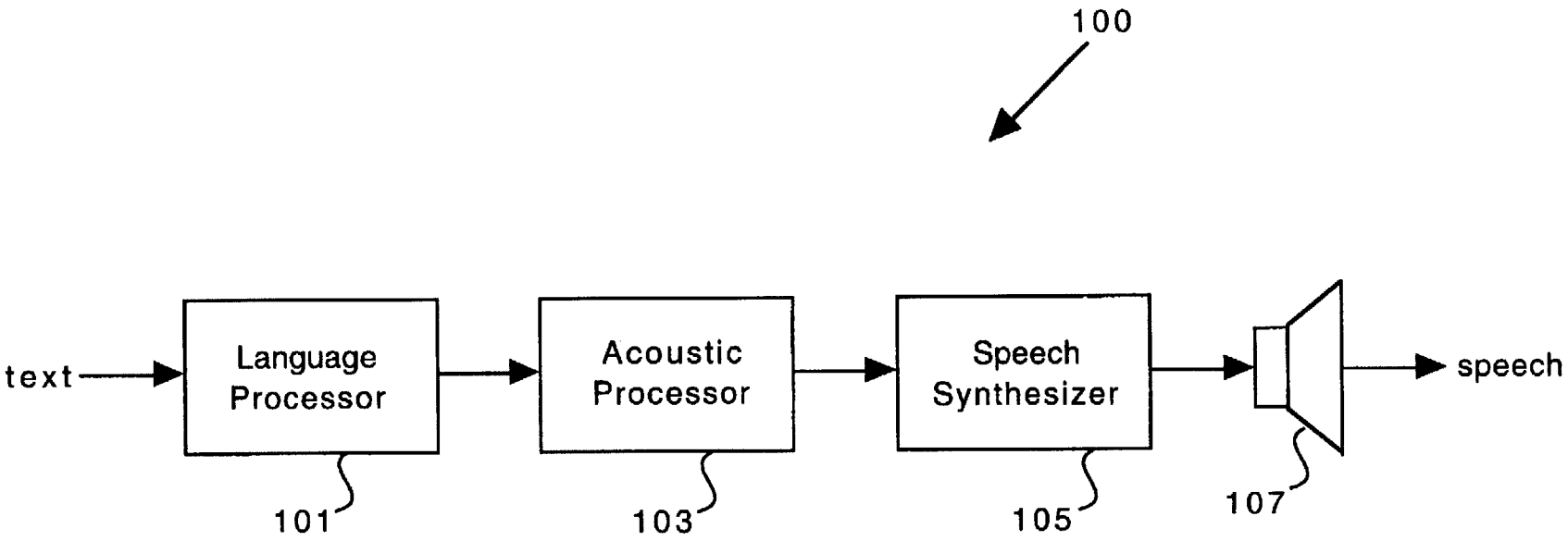
Figure 1 Prior Art
FIG. 1 is a simplified block diagram of a typical prior art synthetic text-to-speech system.
Figure 2:
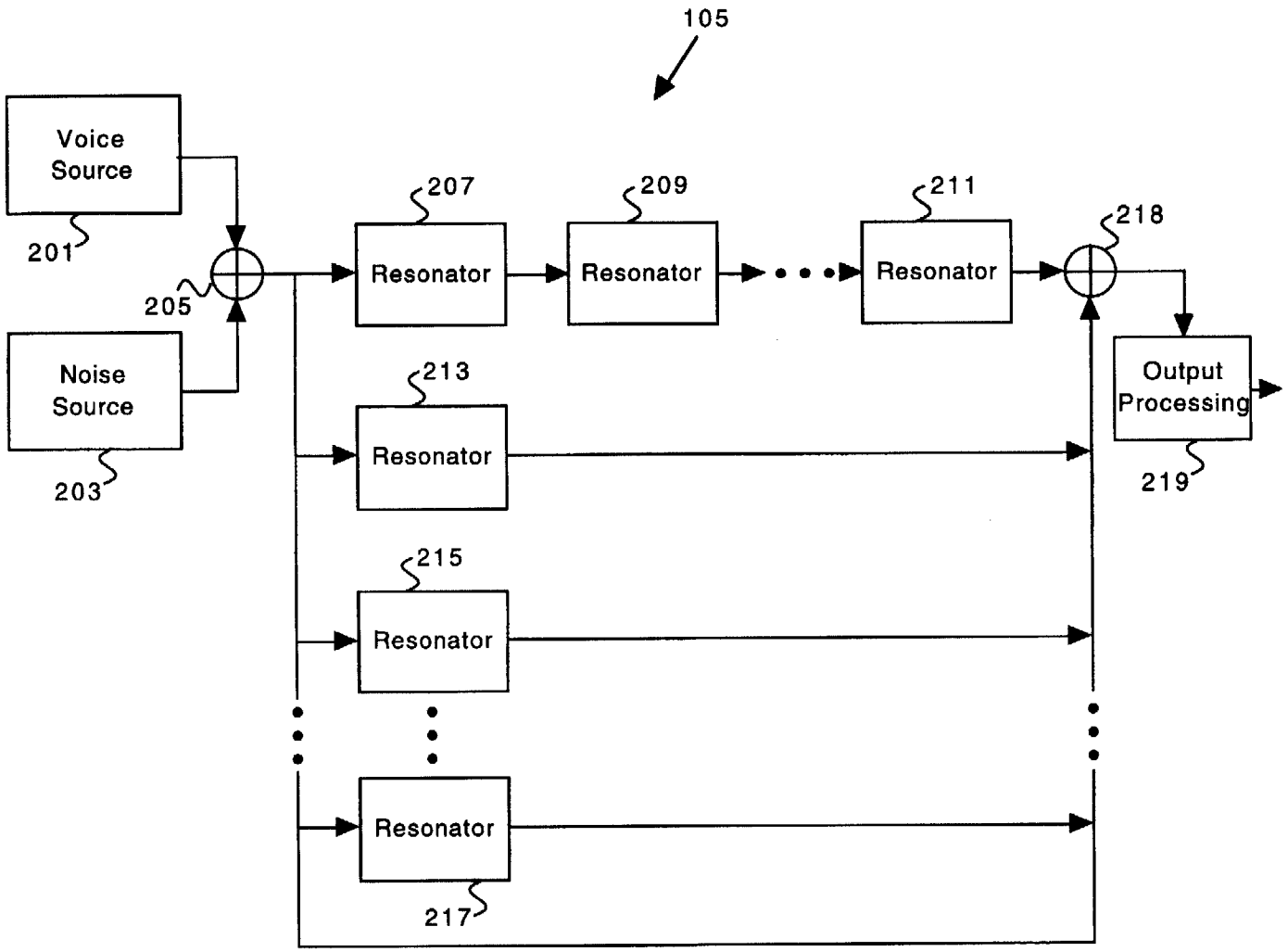
Figure 2 Prior Art
FIG. 2 is a simplified block diagram of a typical prior art speech synthesizer of a synthetic text-to-speech system.

Referring again to FIG. 2, the purpose of voice source 201 is to produce a repetitive sound source. Therefore, what is generally needed is a sound source or wave form with enough spectral information to be modulated by a resonator processor (as is typically used by resonators 207–217 in FIG. 2) to create the necessary formants from the various harmonics of the sound source or wave form. That is why a simple sine wave is not a sufficient voice source (because a sine wave only has one harmonic or formant). Typically, in order to model the human glottis, the voice source 201 uses an impulse wave which, when viewed spectrally, contains a multiplicity of harmonics. Of course, a simple impulse wave, by itself, would sound very unnatural if used in a speech synthesizer due to the lack of other vocal tract information. Therefore, the impulse wave is typically run through a low pass filter which attenuates the high order harmonics thus resulting in a more natural sounding voice source.

Again, as has been explained, continually utilizing a single voice source severely limits the capabilities, flexibility and naturalness of the resulting synthesized speech. Although considerable effort has been expended developing elaborate resonator and filter networks, only so much can be achieved via signal processing of an existing sound source wave form whereas what is really needed is a voice source or sources which singly or when combined have a wave form which already contains the desired spectral qualities.

The present invention is capable of utilizing one or more voice sources wherein each voice source can have different spectral qualities. Having a multiplicity of voice sources having different spectral qualifies can thus provide a higher quality synthesized speech sound as well as a greater range of possible synthesized speech sounds. Choosing the voicing source having the best spectral qualities for the desired synthetic speech can overcome many of the output limitations in the resonator and filter processing of the prior art. Further, utilizing a multiplicity of voice sources, either by combining them in unique ways, cross-fading between them or choosing the most appropriate one, has both the sound quality advantage of providing a truer, richer synthetic speech sound and the performance advantage of not having to further process in real time a single voice source with limited spectral quality in an attempt to achieve the desired results.

Figure 4A:
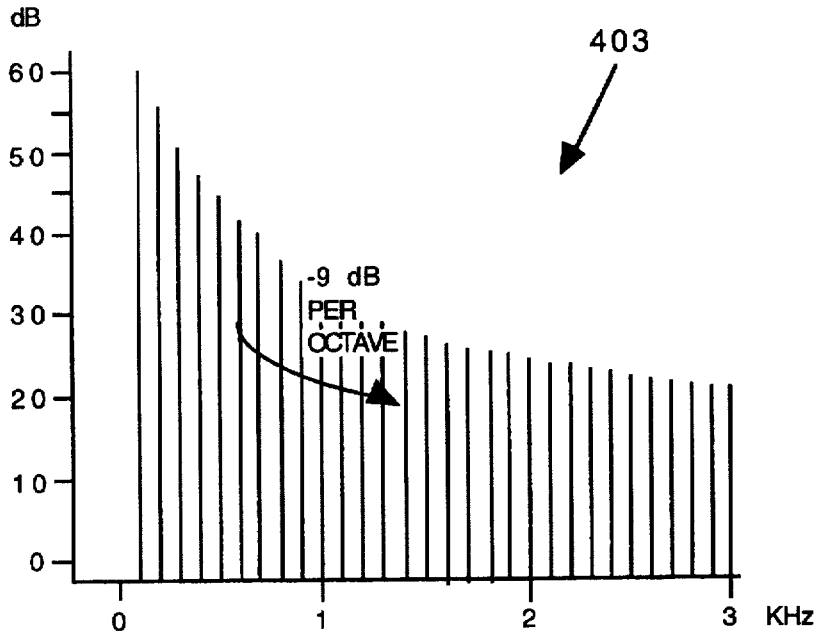
FIGS. 4(*a*), 4(*b*) and 4(*c*) depict spectral charts for three different voice sources.
Figure 4B:
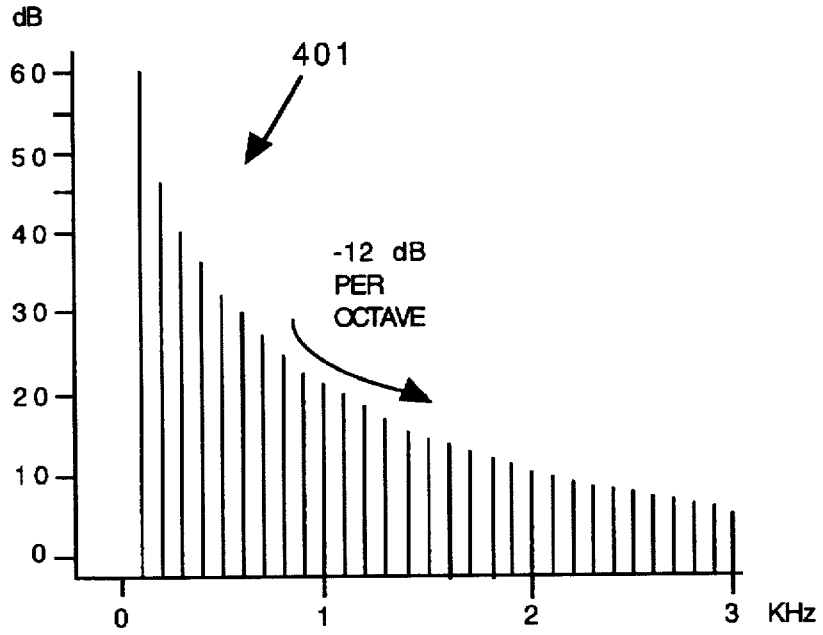
Figure 4C:
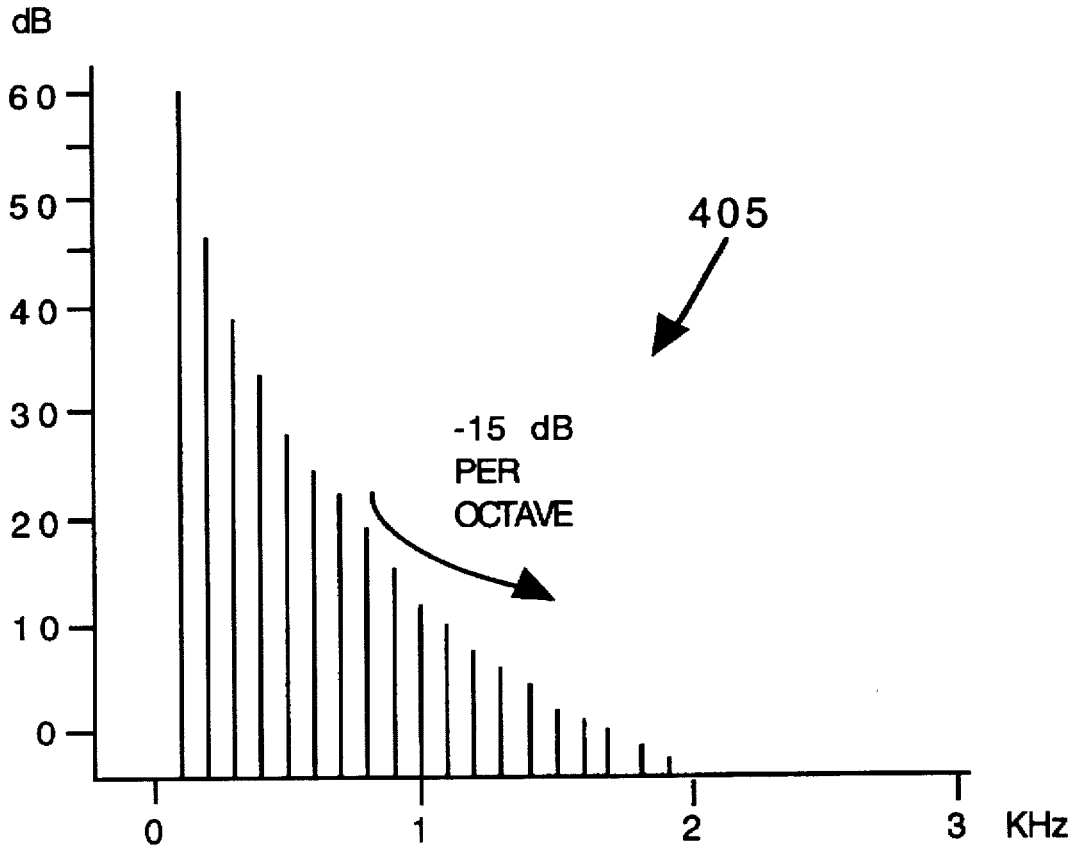
Figure 5A:
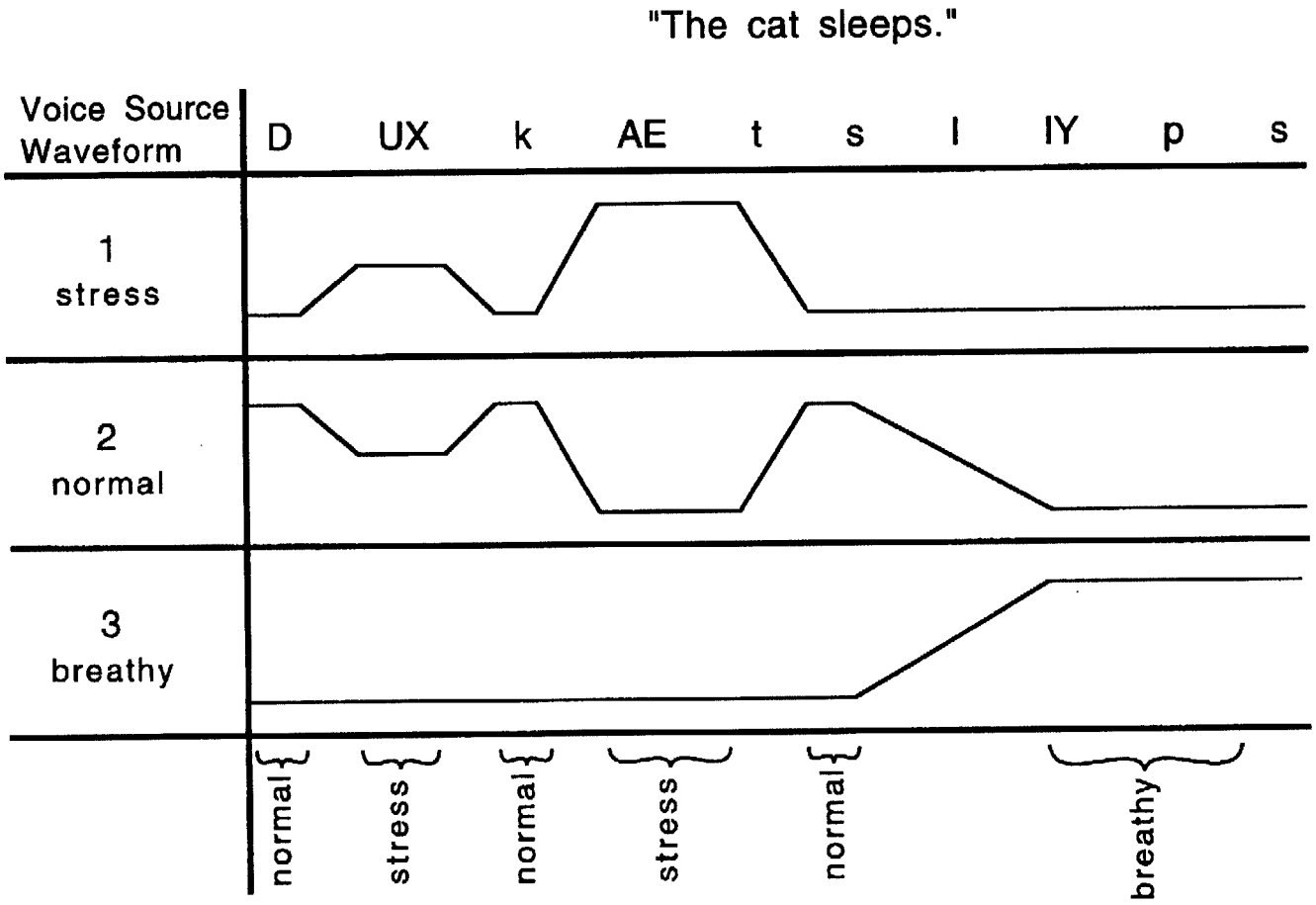
FIGS. 5(*a*) to 5(*d*) depict the proportions and transitions between of various voice sources for an example synthetic speech statement; and, FIGS. 6(*a*), 6(*b*) and 6(*c*) depicts subsegmenting a recorded sound sample and the memory addresses of those recorded subsegments.
Figure 5B:
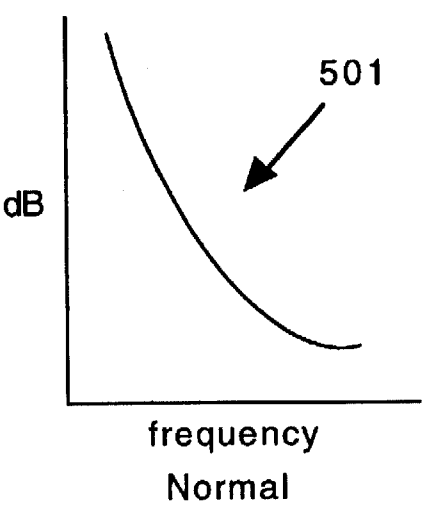
Figure 5C:
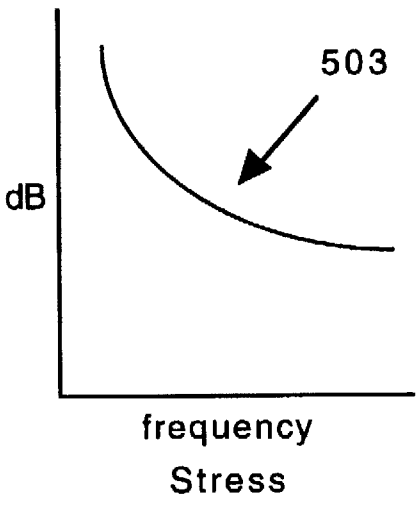
Figure 5D:
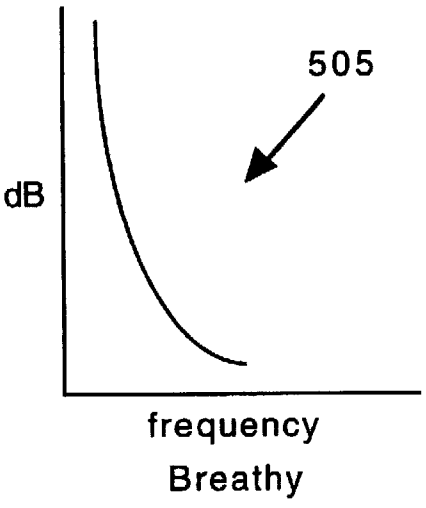

Referring now to FIGS. 4(*a*) to (*c*), three different voice sources 401, 403 and 405 can be seen. The first voice source 401, referred to herein as "Normal", is shown via a spectral function diagram. The Normal voice source 401, wherein as the frequency increases the amplitude decreases at a typical slope of −12/decibels per octave, which rate is well known in the art. The second voice source 403, referred to herein as "Bright", is next shown via a spectral function diagram. The Bright voice source 403, wherein as the frequency increases the amplitude decreases at a less steep slope than the Normal voice source 401, e.g., at a typical slope of −9/decibels per octave, which rate is well known in the art. Bright voice source 403 thus generally contains more harmonic content in the upper spectrum regions than does Normal voice source 401. The third voice source 405, referred to herein as "Glottal", is also shown via a spectral function diagram. The Glottal voice source 405, wherein as the frequency increases the amplitude decreases at a more severe slope than does Normal voice source 401, e.g., at a typical slope rate of −15/decibels per octave. Glottal voice source 405 thus generally contains less harmonic content in the upper spectrum regions than does Normal voice source 401.

It is important to note here that the specific spectral qualities of a particular voice source are not limited to the particular charts depicted in FIGS. 4(*a*) to (*c*). For instance, depending upon the particular speech synthesis system (e.g., formant, parametric, combined parametric and concatenative, etc.) incorporating the present invention or the particular synthetic speech sound desired, the Glottal voice source 405 may more closely resemble the Normal voice source 401 and the Normal voice source 401 may more closely resemble the Bright voice source 403. Further, one aspect of the present invention is the presence and utilization of one or more voice sources which already incorporates the desired spectral qualities (as opposed to having to further process the voice source signal to obtain the desired spectral qualities) while another aspect of the present invention is the presence and utilization of a multiplicity of voice sources which may be used in various combinatorial ways in order to obtain the desired spectral qualities (again, as opposed to having to further process the voice source signal to obtain the desired spectral qualifies).

The present invention can thus select between, or combine as needed, the various voice sources available to speech synthesizer 105 in order to achieve the desired synthetic speech. For example, if the desired synthetic speech is supposed to sound bored, a voice source of the Glottal voice source 405 having few formants might be desirable. Conversely, if the desired synthetic speech is supposed to sound angry, a voice source of the Bright voice source 403 having many formants might be desirable. And if the desired synthetic speech is supposed to sound normal, a voice source of the Normal voice source 403 having a medium number of formants might be desirable.

However, this is a slightly simplistic view of what occurs in real human speech. Real human speech is not typically comprised entirely of all one type speech sound. In other words, real human speech doesn't typically operate in the realm of exclusively one spectral quality. For instance, real human speech sounding excited would likely fall in the range between Normal voice source 401 and Bright voice source 403 and, further, would likely vary slightly between those two voice sources as the speech occurred. In other words, a given speech emotion or vocal quality doesn't have to be limited to just one voice source having just one set of spectral qualities and can either select between, or use combinations of, different voice sources.

As an example of different emotional and vocal qualities generated with synthetic speech according to the present invention please refer to Table 1 herein. Table 1 shows a variety of possible emotions and/or vocal qualities which might be desired in a synthetic speech system. For each emotion and/or vocal quality, it can be seen that a different combination of voice sources could be used. For example, the emotional quality angry is primarily, if not entirely, comprised of the Bright voice source. Conversely, the emotional quality of loud is primarily of the Bright voice source but also contains some portion of the Normal voice source.

TABLE 1

| 100% Bright voice source | 100% Normal voice source | 100% Glottal voice source |
|---|---|---|
| load angry | excited | soft breathy |
| happy | | bored |
| | stressed | unstressed |

Note that with a loud synthetic speech emotional quality the exact proportion of Bright voice source versus Normal voice source is less an absolute determination and is more a matter of difference and degree as compared to other emotional/vocal qualities. In other words, it is less important in the present invention that the proportion of Bright to Normal voice source for the loud emotional/vocal quality be an absolute number (say 90% Bright and 10% Normal) and it is more important in the present invention that the proportion of Bright to Normal voice source for the loud emotional/vocal quality be generally something less than with the angry emotional/vocal quality. In this way, the listener of the synthetic speech can hear the difference between one emotional/vocal quality as compared to another emotional/vocal quality rather than be concerned with whether the particular synthetic speech sound is some absolute measure of a particular emotional/vocal quality.

Further note that this is consistent with real human speech in that one individual's speech generation of angry is not necessarily the same as another individual's. Generally, the way one determines that the sound of a real human speaker is of a particular emotional/vocal quality is based on (among a variety of clues including non-verbal ones) its variance from some very general or broad norm (e.g., societal, or prior familiarity with the individual speaker). For example, angry tends to be more bright than just loud and that is why synthesized speech depicting angry should have more of the bright voice source than should just loud. However, again, there is no absolute rule which says that angry has to be 100% bright voice source or that loud has to be 90% bright voice source and 10% normal voice source, either in general or for a particular synthetic speaker.

Still further, note that the proportions of different voice sources does not have to remain static within a particular word, syllable, or phoneme. The voice source proportions can vary, for instance, by as much as the particular speech synthesizer is capable of handling.

Referring now to FIGS. 5(*a*) to (*d*), an example of the use of different voice sources having different voice colorations in accordance with the present invention will now be explained. An input text string of "The cat sleeps." is convertible to the phonetic or allophonic equivalent "D—UX—k—AE—t—s—l—IY—p—s". In this example, Speech Synthesizer 105 has at least three voice sources, Normal 501, Stress 503 and Breathy 505. Acoustic Processor 103 annotates the input phonetic string with the appropriate vocal parameters so as to inform Speech Synthesizer 105 which, and how much of each, voice source to use for each phonetic element. In the example in the figure it can be seen that the first phonetic element "D" is primarily comprised of Normal voice source 501 but also has some amount of Stress voice source 503.

Again, the exact amount and proportion of each voice source can vary depending upon, among other things, the particular speech synthesizer used, the synthetic speech system implementor's choices and the particular user's preferences. Therefore, while there is no requirement that it be so, in this example the first phonetic element "D" might be comprised of approximately 90% Normal voice source 501 and 10% Stress voice source 503 as indicated by the charts underneath phonetic element "D" depicting the speech synthesizer amplitude of available voice sources. Similarly, the next phonetic element "UX" might be comprised of approximately 60% Normal voice source 501 and 40% Stress voice source 503 as indicated by the charts underneath phonetic element "UX" depicting the speech synthesizer amplitude of available voice sources.

Note further that the transition between phonetic elements is a smoothly varying one in accordance with human speech. These transitions between phonetic elements are merely a function of the signal processing which occurs between phonetic elements and which continues through the subsequent phonetic element in order to facilitate the various proportions of available voice sources. Note that in the preferred embodiment of the present invention the signal processing is primarily a function of voice source gain amplitude (as indicated to the speech synthesizer in the annotations placed on the phonetic elements by the acoustic processor) combined with cross fading between voice sources, however there is a wide variety of possible signal processing means and techniques known in the art which are equally applicable to such combinatorial and transitional signal processing.

Another possibility with the multiplicity of voice sources available to the speech synthesizer of the present invention is to utilize a recorded sound sample as a voice source rather than the wholly synthetic voice source typically used by a parametric speech synthesizer or the human speech samples typically used by a concatenative speech synthesizer. For example, if it is desired in a children's computer game or learning program to have a non-human object speak, utilizing a wholly synthetic voice source having spectral qualities desirable for a synthetic human voice would not likely sound like the non-human object is speaking as much as it would sound like a human (or, at least a synthetic human voice) were speaking for the non-human object. In other words, if in a children's computer game or learning program it is desirable to have a teakettle talk, using a voice source based on spectral qualities associated with a human voice misses the point. It would be much more desirable to have the synthetic speech of the teakettle be based on the particular spectral qualities of the sound a teakettle makes.

By recording a sample of the teakettle to then be used as the voice source, in order to generate synthetic speech for the teakettle, when the teakettle speaks via the speech synthesizer the speech will have more of the spectral qualities of the sound of the teakettle. Of course, most if not all of the other typical speech parameters are still utilized in order to make the teakettle synthetic speech understandable. For example, at the very least, the text which the teakettle is to speak is another parameter or input to the speech synthesis system utilizing the teakettle sound sample. Also, the variety of prosody parameters typically utilized in a speech synthesis system would all generally be applicable to the teakettle synthetic speech. Further, the emotional/vocal qualities, as evidenced above via combining other voice sources could also be combined with the teakettle sample voice source to provide a richer, more life-like talking teakettle.

Of course, the present invention is not limited to merely generating talking inanimate objects for the pleasure or education of young children. In other words, a great variety of sampled sounds could be used for an endless range of synthetic speech possibilities. A recorded sample from, e.g., an organ could likewise be used as a voice source, either because of its particularly useful resonance or merely because of its particularly enjoyable tonal qualities. A recorded sample from, e.g., a car horn, a pig snorting, a person laughing or snoring, or a dog barking, could likewise be used a voice source, again because of its particular spectral qualities or because of its particularly enjoyable or humorous qualities. In this way, synthetic speech for an animal or even a human character would be generated which thus has unusual or even unique sound qualities. Clearly the possibilities are endless, as to variety of sound samples, as to possible uses, as to educational and/or comic value, and as to resulting synthetic speech sound qualifies.

Further, the ways in which recorded sound samples can be used as voice sources is likewise essentially limitless with the present invention. The recorded sound wave sample could be used in a one shot mode wherein the wave sample is played from its beginning to its end at the start of every syllable or voiced phoneme. This would likely be most useful for sound wave samples which are either sustained for only short periods of time or for percussive sounds with fast decays to silence. Examples of these types of wave samples might include a human glottal wave sample (e.g., a cough, sigh, or sneeze), a percussive musical instrument (e.g., a snare drum or plucked violin), or various special effects (e.g., a water droplet, dog bark, or telephone ring).

Figure 6A:
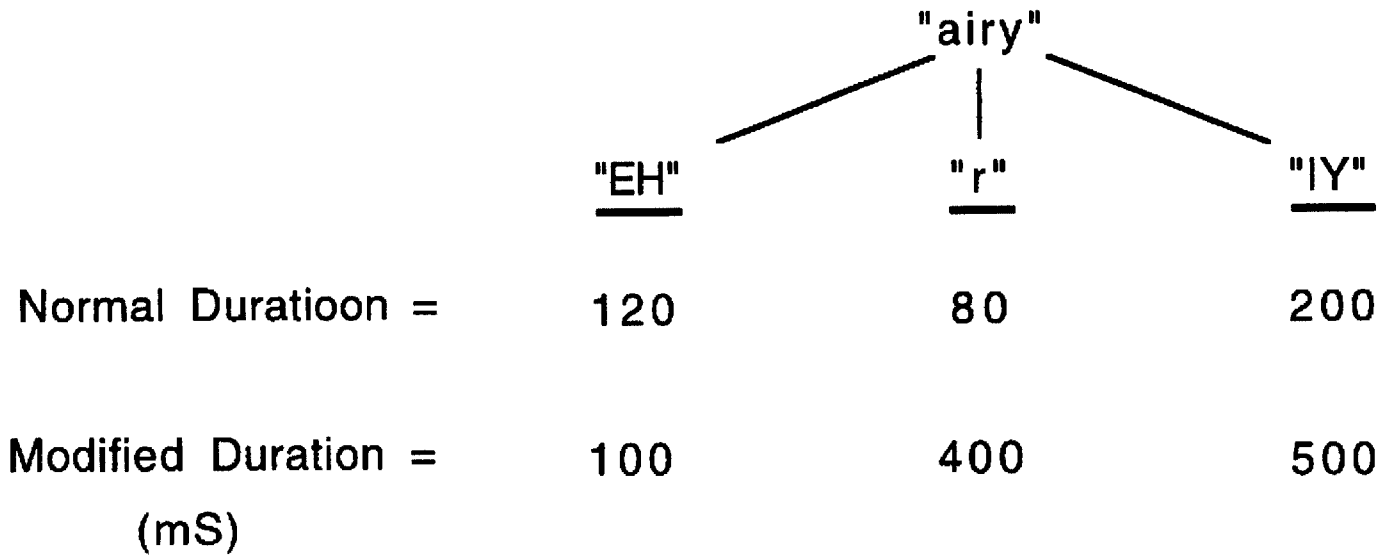
Figure 6C:
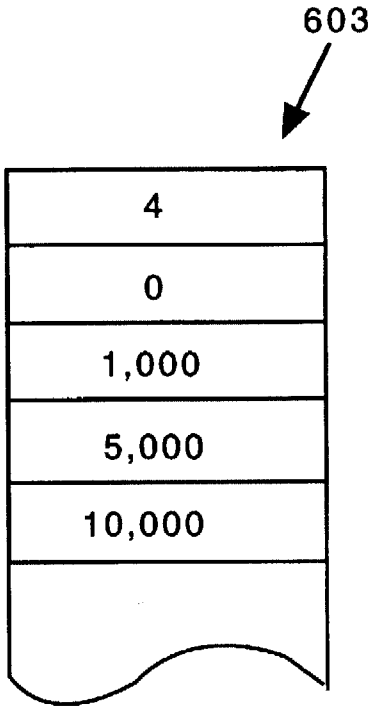
Figure 6B:
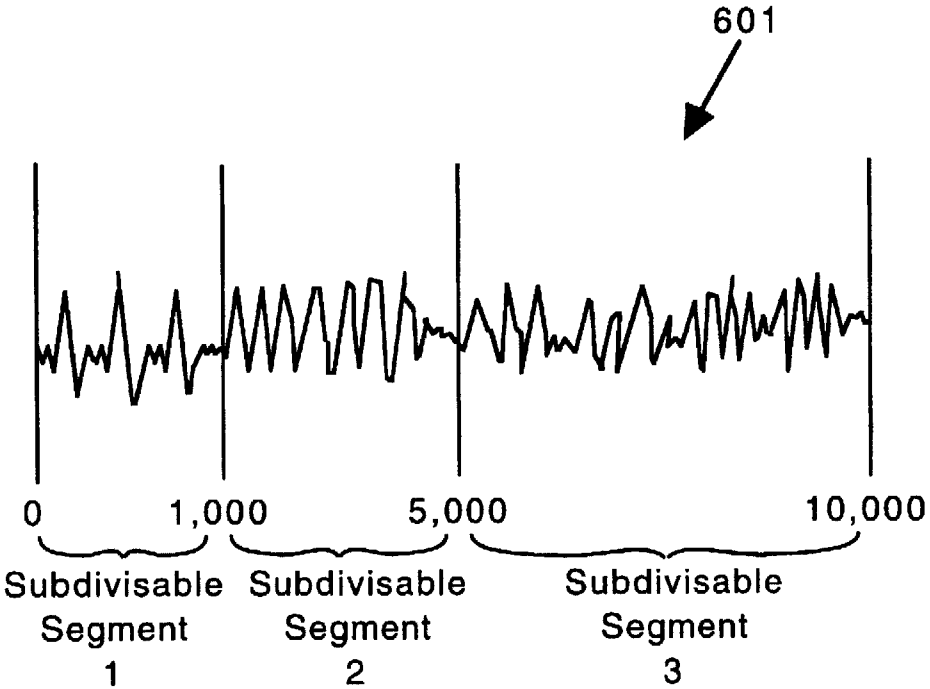

Another way in which a recorded sound sample could be used is in a loop mode wherein the wave sample is continuously played by looping back to the beginning when the end of the sample is reached. This would likely be most useful for sound wave samples which are sustained indefinitely Or cyclically repeat a pattern. Examples of these types of wave samples might include a human glottal wave sample (e.g., laughter or snoring), a sustained musical instrument without an attack (e.g., an organ or a chorus), recorded music (e.g., a trumpet playing the tune "Ma-ry had a lit-tle lamb"), or a variety of special effects (e.g., a car horn or a pig snorting). Using a recorded sound sample in a loop mode can be accomplished by having the acoustic processor synchronize the duration of the phonemes to various acoustic events from a list of indexes into the wave sample, as is explained more fully below with reference to FIGS. 6(*a*) to (*c*).

Still another way in which a recorded sound sample could be used is in a one shot with loop mode wherein a portion of the wave sample is played once (the "one-shot" portion) and another portion of the wave sample is continuously repeated (the "loop" portion). This would likely be most useful for sound wave samples which are either indefinitely sustained but have unique onset characteristics or are percussive sounds with a slow decay. Examples of these types of wave samples might include sustained musical instruments with an attack (e.g., a violin or tuba), percussive musical instruments (e.g., a tympani or piano), or a variety of special effects (e.g., a bell or steam whistle).

Yet still another way in which a recorded sound sample could be used is by combining a one shot mode sound sample with a loop mode sound sample in the same way as with a one shot with loop mode sound sample. That is, the one shot mode sound sample would be played once while the loop mode sound sample would then be continuously repeated. Note further that the order of playing the sound sample is nowhere limited in the present invention to playing the one shot mode sound sample before the loop mode sound sample because the loop mode sound sample could just as easily be played for some period of time before playing the one shot mode sound sample.

Deciding how a particular sound sample is to be used varies, as was indicated above, by the type of sound sample recorded and by the desired effect to be achieved in the synthetic speech. For example, a one second long given sound wave sample 601 has been recorded at a sample rate of 10,000 samples per second thus yielding 10,000 digital samples having been recorded for the entire sound wave sample. In this example, based either on the particular spectral qualities of the recorded sound sample 601 or on the particular synthetic speech to be produced, the recorded sound wave sample 601 is subdivided into three separable sound wave samples denoted subdivisible segments 1, 2 and 3. As indicated in the figure, subdivisible segment 1 is comprised of the first 1,000 (1,000–0) digital samples, subdivisible segment 2 is comprised of the next 4,000 (5,000–1,000) digital samples and subdivisible segment 3 is comprised of the next, or last, 5,000 (10,000–5,000) digital samples. Note that the number of digital samples recorded for each subdivisible segment is a function of the recording sample rate and the particular decisions made as to where the recorded sound sample is to be subdivided (if at all).

In the preferred embodiment of the present invention, the recorded sound sample 601 is stored in memory and a table 603 is created with pointers to the beginning of each sub divisible segment of the sound sample as well as a pointer to the end of the recorded sound sample. The first entry in table 603 indicates the number of recorded sound sample memory addresses stored (which, by definition, will always be one greater than the total number of subdivisible segments of the recorded sound sample). Each subsequent entry in table 603 contains the address of the next subdivisible segment of the recorded sound sample.

When it is desired to synthesize a particular portion of text, as was explained above, the text is broken down into its phonetic or allophonic equivalents. For example, referring to FIG. 6(*a*), if it is desired to have the speech synthesizer say the word "airy", the phonetic equivalent is determined to be "EH—r—IY". In a typical prior art speech synthesizer, the duration of those phonemes might be 120 millisecond (mS) for "EH", 80 mS for "r" and 200 mS for "IY". However, in the present invention, because the desired spoken word "airy" is to be spoken with a recorded sound sample, a mapping is made between the phonemes to be spoken and the duration of the subdivisable segments of the recorded sound sample to be used as voice sources for each phoneme.

In the preferred embodiment of the present invention, the amount of time each phoneme will be synthesized using a given subdivisible segment of the recorded sound sample is determined according to the following formula:

segment time=(no. of digital samples in that segment)/(digital sample rate)

where the "number of digital samples in that portion" refers to the number of digital samples taken for the particular subdivisable segment of the recorded sound wave sample which will be used for the voice source for the particular phoneme to be synthetically spoken. Referring again to the example where the word "airy" is to be synthetically spoken, for the first phoneme ("EH"), the segment time which the first subdivisible segment of the recorded sound sample will be used is, according to the formula above, (1,000–0)/10,000=100 mS. Similarly, for the second phoneme ("r"), the segment time which the second subdivisible segment of the recorded sound sample will be used is (5,000–1,000)/10,000=400 mS. Lastly, for the third phoneme ("IY"), the segment time which the third subdivisible segment of the recorded sound sample will be used is (10,000–5,000)/10,000=500 mS.

An alternative embodiment of the present invention combines phonemes into syllables and then operates on a syllable by syllable basis, rather than operating on a phoneme by phoneme basis as was done in the example above. Note that this works particularly well for recorded sound samples which have a greater periodicity, e.g., a series of struck musical bells, rather than with a more random recorded sound sample. Using the same recorded sound sample of FIG. 6(*b*), an example of operating on a syllable by syllable basis will now be explained. If the word "Mary" was to by synthetically spoken, the phonetic equivalent would be "m—EH—r—IY". Further, in a typical prior art synthetic speech system, the synthetically spoken duration of those phoneroes might be 60 mS for "m", 120 mS for "EH", 80 mS for "r" and 200 mS for "IY".

However, "Mary" is comprised of the two syllables "m—EH" and "r—IY". Therefore, operating on a syllable by syllable basis, and with the first two phonemes comprising the first syllable, the total duration for the first syllable of "Mary" in a typical prior art synthetic speech system might be 60+120=180 mS. Using subdivisible segment 1 of the recorded sound sample 601 of FIG. 6(*b*) for the first syllable of the word "Mary" would result in a total segment time for the first syllable of the word "Mary", according to the formula above, of (1,000–0)/10,000=100 mS. However, because consonants should generally retain their normal duration time else they generally sound unnatural, the consonant portion ("m") of the first syllable of the word "Mary" should retain its typical duration of 60 mS. Therefore, subtracting the segment time (60 mS) of the consonantal portion ("m") of the syllable from the total segment time of 100 mS yields a remaining duration of 40 mS for the vowel portion ("EH") of the syllable. In this way, the first syllable of the word "Mary" to be synthetically spoken would utilize the 100 mS subdivisible segment 1 of recorded sound wave sample 601 as the voice source.

Similarly, with the second two phonemes "r" and "IY" comprising the second syllable of "Mary", the total duration for the second syllable of "Mary" in a typical prior art synthetic speech system might be 80+200=280 mS. Using the second subdivisible portion of the recorded sound sample of FIG. 6(*b*) for the second syllable of the word "Mary" would result in a total segment time for the second syllable of the word "Mary", according to the formula above, of (5,000–1,000)/10,000=400 mS. And, again, because consonants should generally retain their normal duration time else they start to sound unnatural, the consonant portion ("r") of the second syllable of the word "Mary" should retain its typical duration of 80 mS. Therefore, subtracting the segment time (80 mS) of the consonantal portion ("r") of the syllable from the total segment time of 400 mS yields a remaining duration of 320 mS for the vowel portion ("EH") of the syllable. In this way, the second syllable of the word "Mary" to be synthetically spoken would utilize the 400 mS sub divisible segment 2 of recorded sound wave sample 601 as the voice source.

In the foregoing specification, the present invention has been described with reference to a specific exemplary embodiment and alternative embodiments thereof. It will, however, be evident that various modifications and changes may be made thereto without departing from the broader spirit and scope of the invention as set forth in the appended claims. The specifications and drawings are, accordingly, to be regarded in an illustrative rather than a restrictive sense.

What is claimed is:

1. A synthetic text-to-speech generating method comprising:

generating a set of speech synthesizer control parameters representative of text to be spoken; and converting the speech synthesizer control parameters into output wave forms representative of the synthetic speech to be spoken by selecting and combining at least two voice sources from a multiplicity of voice sources in a speech synthesizer to generate a combined voice source and by passing the combined voice sottree through an acoustic model of a human vocal tract.

2. The method of claim 1 wherein said step of selecting is based upon which of the multiplicity of voice sources has spectral content which most closely matches that of the generated set of speech synthesizer control parameters.

3. The method of claim 1, wherein said multiplicity of voice sources includes a normal voice source and a bright voice source.

4. The method of claim 3, wherein said multiplicity of voice sources includes a glottal voice source.

5. An apparatus for generating synthetic text-to-speech, the apparatus comprising:

means for generating a set of speech synthesizer control parameters representative of text to be spoken; and means for converting the speech synthesizer control parameters into output wave forms representative of the synthetic speech to be spoken by means for selecting and combining at least two voice sources from a multiplicity of voice sources in a speech synthesizer to generate a combined voice source and means for passing the combined voice source through an acoustic model of a human vocal tract.

6. The apparatus of claim 5 wherein said means for selecting is based upon which of the multiplicity of voice sources has spectral content which most closely matches that of the generated set of speech synthesizer control parameters.

7. The apparatus of claim 5, wherein said multiplicity of voice sources includes a normal voice source and a bright voice source.

8. The apparatus of claim 7, wherein said multiplicity of voice sources includes a glottal voice source.

9. A method of generating synthetic speech in a synthetic speech system comprising a speech synthesizer, said synthetic speech generating method comprising the steps of:

a) providing a multiplicity of synthetic voice sources to said speech synthesizer;

b) providing a set of speech synthesizer control parameters to said speech synthesizer;

c) said speech synthesizer selecting at least two of said multiplicity of voice sources based upon said set of speech synthesizer control parameters;

d) said speech synthesizer combining the Selected voice sources to generate a combined voice source; and e) generating said synthetic speech based upon said set of speech synthesizer control parameters and using said combined voice source.

10. The synthetic speech generating method of claim 9 wherein said multiplicity of voice sources are predetermined to have desired spectral content.

11. The synthetic speech generating method of claim 10 wherein said step of selecting at least two of said multiplicity of voice sources comprises selecting at least one voice source having spectral content which most closely matches that of the provided set of speech synthesizer control parameters.

12. The method of claim 9, wherein said multiplicity of voice sources includes a normal voice source and a bright voice source.

13. The method of claim 12, wherein said multiplicity of voice sources includes a glottal voice source.

14. A text-to-speech synthesizer system for generating a synthetic speech signal, the synthesizer system comprising:

a phonetic translation of text to be spoken by the text-to-speech synthesizer system;

a multiplicity of audio signals to be used as voice sources by the text-to-speech synthesizer system; and an acoustic model of a human vocal tract, the acoustic model selectively receiving as input at least two of the multiplicity of audio signals and the phonetic translation, the acoustic model acoustically modifying the received audio signals based upon the phonetic translation to generate a modified voice source, and the acoustic model outputting the modified voice source as the synthetic speech signal.

15. A parametric synthetic text-to-speech system comprising:

a memory containing a multiplicity of digitally sampled voice sources and a set of text-to-speech parameters indicative of text to be spoken by the synthetic text-to-speech system;

a filter network for modulating two or more of the multiplicity of voice sources in accordance with the set of text-to-speech parameters to generate a modulated voice source, the filter network modeling the acoustic aspects of the human vocal tract;

a loudspeaker for generating a waveform of the synthetic speech utilizing the modulated voice source.

16. A text-to-speech synthesizer system for generating a synthetic speech signal, the synthesizer system comprising:

a phonetic translation of text to be spoken by the text-to-speech synthesizer system;

two audio signals to be used as voice sources by the text-to-speech synthesizer system;

an acoustic model of a human vocal tract for receiving the two audio signals and the phonetic translation, combining and modifying the two audio signals based upon the phonetic translation, and outputting the combined and modified two audio signals as the synthetic speech signal.

17. The system of claim 16 wherein the two audio signals each has different spectral qualities.

18. The system of claim 17 wherein the acoustic model uses proportionately more of one of the two audio signals than another of the two audio signals when combining the two audio signals.

19. The system of claim 18 wherein the proportionate usage of the two audio signals by the acoustic model is variable.

20. The system of claim 17, wherein a first of said audio signals has spectral qualities of a normal voice and a second of said audio signals has spectral qualities of a bright voice.

21. The apparatus of claim 20, further including a third audio signal to be used as a voice source by the text-to-speech synthesizer system, said third audio signal having spectral qualities of a glottal voice.

* * * * *

UNITED STATES PATENT AND TRADEMARK OFFICE

CERTIFICATE OF CORRECTION

PATENT NO : 5,704,007

DATED : December 30, 1997

INVENTOR(S) : Cecys, Mark L.

It is certified that error appears in the above-identified patent and that said Letters Patent is hereby corrected as shown below:

In the claims:

In Claim 1, at column 12, line 16, delete "sottree" and insert --source--.
In Claim 9, at column 12, line 60, delete "Selected" and insert --selected--.

Signed and Sealed this

Seventh Day of September, 1999

*Attest:*

Q. TODD DICKINSON

*Attesting Officer*

*Acting Commissioner of Patents and Trademarks*